United States Patent [19]

Sher

[11] Patent Number: 5,065,886

[45] Date of Patent: Nov. 19, 1991

[54] STRUCTURE OF DUST BIN

[76] Inventor: Chen-Hsien Sher, No. 18, Lane 195, Nan Tai Rd., Kaohsiung City, Taiwan

[21] Appl. No.: 691,813

[22] Filed: Apr. 26, 1991

[51] Int. Cl.[5] ..... B65D 43/20

[52] U.S. Cl. ..... 220/331; 220/87.1; 220/655; 220/908; 206/0.5

[58] Field of Search ..... 220/331, 87.1, 85 K, 220/908; 312/276, 189; 206/0.5

[56] References Cited

U.S. PATENT DOCUMENTS

| | | | |
|---|---|---|---|
| 1,135,426 | 4/1915 | Bauman | 220/331 |
| 3,131,841 | 5/1964 | Grogan | 220/371 |
| 3,995,764 | 12/1976 | Zagami | 220/331 |
| 4,320,852 | 3/1980 | Nagelkirk | 220/331 |
| 4,732,295 | 3/1988 | Horinchi | 220/331 |
| 4,821,902 | 4/1989 | May | 220/331 |

*Primary Examiner*—Joseph Man-Fu Moy
*Attorney, Agent, or Firm*—Bacon & Thomas

[57] ABSTRACT

A dust bin of the type comprising a container having a top opening covered with a removable cover, wherein said container has a flat, hollow chamber separately vertically disposed at the inside for receiving said cover when said cover is not in use, and two bolts at two opposite locations for releasably mounting said cover through hooked-joint permitting said cover to be rotated on said two bolts to close or open said top opening. A chemical case which has aromatic compounds or deodorant contained therein is attached to the container to fit flush with the bottom edge of the bottom projection which projecting from the bottom of the container.

5 Claims, 2 Drawing Sheets

STRUCTURE OF DUST BIN

BACKGROUND OF THE INVENTION:

The present invention relates to dust bins and relates more particularly to a dust bin which has a separated chamber therein for receiving the cover thereof when the cover is not in use.

A dust bin generally has a cover, either of fixed or removable type, to cover the top opening thereof, so as to prohibit insects from entering the dust bin and simultaneously mask the offensive-smelling of the dust and rubbish contained therein. One disadvantage of conventional dust bins is that a cover may be unable to tightly close the top opening of a dust bin. Another disadvantage of the conventional dust bins is that a cover may be carelessly disposed of, just like a dust itself, when it is not in use, causing pollution problem.

SUMMARY OF THE INVENTION

The present invention has been accomplished to eliminate the aforesaid problems. It is therefore an object of the present invention to provide a structure of dust bin which has a separate chamber therein for receiving the cover, which is used to cover the top opening of the dust bin, without occupying extra floor space.

It is another object of the present invention to provide a structure of dust bin which has rubber packing covered on the top edge thereof so that the top opening thereof can be tightly closed by a cover.

It is still another object of the present invention to provide a structure of dust bin which has a movable cover attached thereto to cover the top opening thereof, which movable cover has a retaining projecting at the front end thereof to engage with the rubber packing on the top edge of the dust bin so as to firmly secure the movable cover in position when the movable cover is covered on the dust bin.

It is still another object of the present invention to provide a structure of dust bin which has a movable cover for covering the top opening thereof, which movable cover can be conveniently drawn out from a chamber therein to tightly close the top opening thereof or pushed back to become concealed inside said chamber.

It is a yet further object of the present invention to provide a structure of dust bin which has holder means on the bottom of the cover thereof as well as at the inside for holding camphor balls or other deodorants to remove and mask the bad odor of the dust and rubbish contained in the dust bin.

DETAILED DESCRIPTION OF THE PREFERRED EMBODIMENTS

Figure 1:
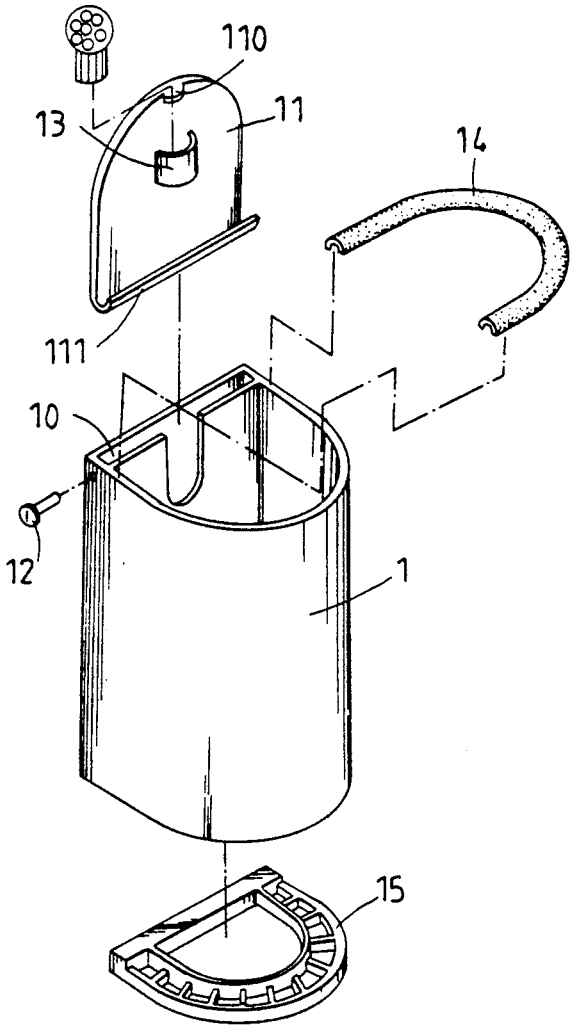
FIG. 1 is a dismantled perspective view of the preferred embodiment of the dust bin of the present invention.
Figure 2:
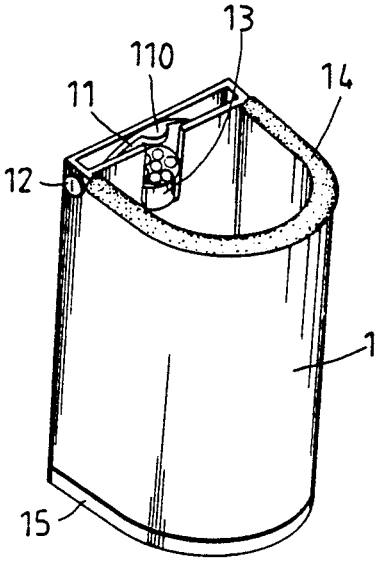
FIG. 2 is a perspective view thereof wherein the cover is received in the chamber inside the body.

Referring to FIGS. 1 and 2, a dust bin in accordance with the present invention is generally comprised of a body 1 for collecting dust, rubbish, etc., and a cover 11 covering over said body 1 at the top. A flat, hollow chamber 10 is vertically defined inside the body 1 at the back for receiving the cover 11 when the cover 11 is not in use. A rubber packing 14 is mounted on the top edge of the body 1 so that the body 1 can be completely enclosed by the cover 11. The cover 11 has a retaining projection 110 at the front end thereof which is engaged in the top front edge of the body 1 to secure the cover 11 in place when the cover 11 is covered on the body 1 at the top, a hooked portion 111 at the rear end thereof which is pivotably hooked on two bolts 12 which are bilaterally fastened on the body 1 into the chamber 10, and a holder plate 13 at the center of the bottom surface thereof for holding a camphor box which contains camphor balls to repel insects, prevent and destroy undesired odors. Inside the body 1, there is also provided a holder plate 112 for holding a camphor box 113. The body 1 further comprises a projecting bottom edge 16 at the bottom. A substantially loop-shaped chemical case 15 is attached the body 1 at the bottom to fit flush with the projecting bottom edge 16. The chemical case 15 defines therein a plurality of compartments for holding aromatic compounds.

Figure 3:
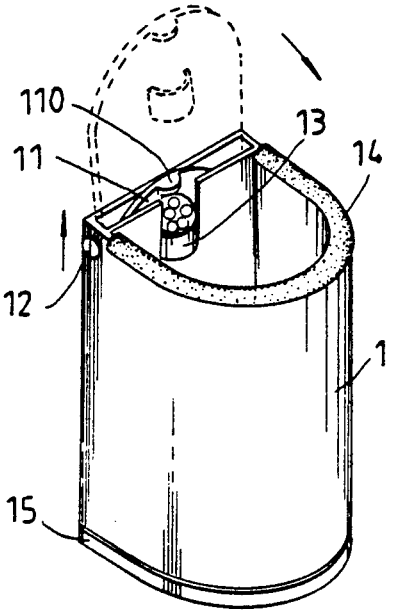
FIG. 3 illustrates the direction in drawing out the cover from the chamber inside the body for covering on the body at the top.
Figure 4:
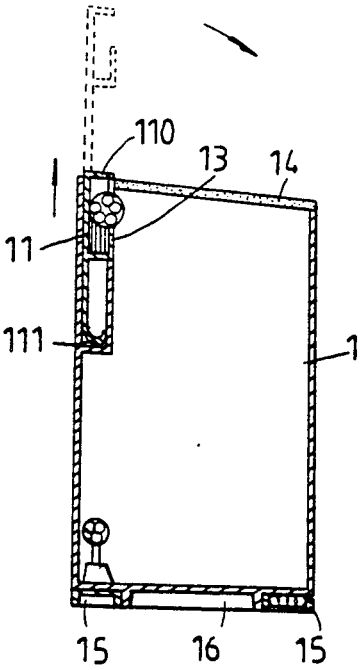
FIG. 4 is a sectional view taken on FIG. 3 along longitudinal direction.
Figure 5:
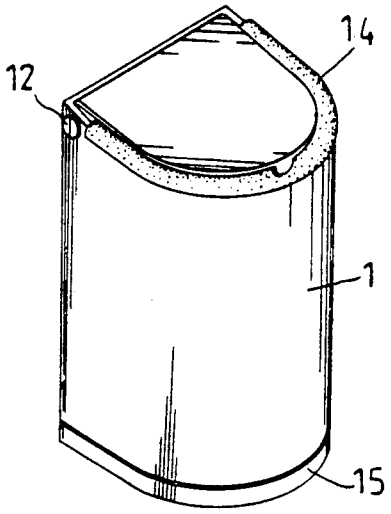
FIG. 5 is a perspective view of the dust bin wherein the cover is covered on the body at the top.
Figure 6:
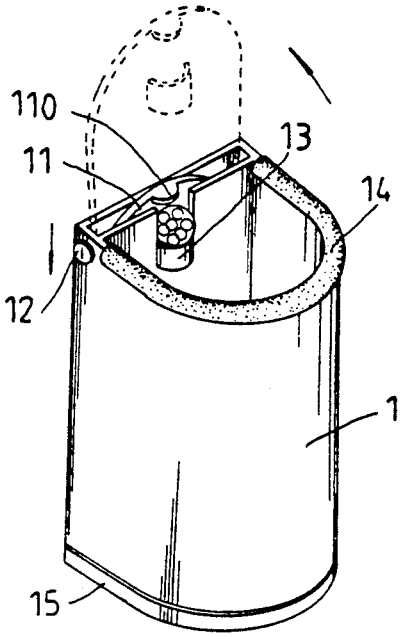
FIGS. 6 and 7 illustrate a procedure to remove the cover from the rubber packing on the top edge of the body into the chamber inside the body.
Figure 7:
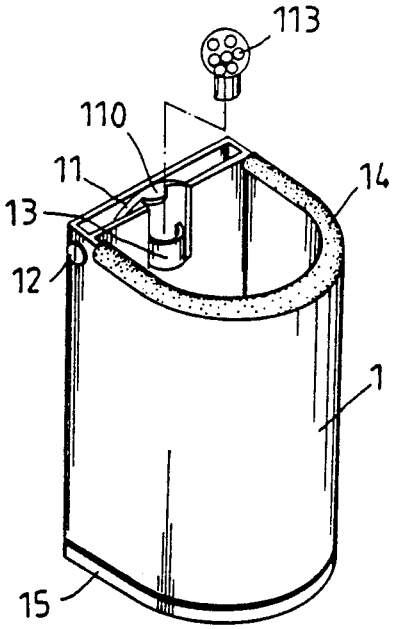

Referring to FIGS. 3, 4 and 5, by pulling the retaining projection 110, the cover 11 is drawn out of the chamber 10 causing the hooked portion 111 thereof to be hooked on the two bolts 12. As soon as the hooked portion 111 hooks on the two bolts 12, the cover 11 is rotated downwards on the two bolts 12 to cover on the body 1 at the top. By engaging the retaining projection 110 (which is made of resilient material) with the body 1, the cover 11 is firmly retained in a horizontal position tightly covering over the rubber packing 14. When not in use, the cover 1 is lifted from a horizontal position to a vertical position and then, moved back into the chamber 10 (as shown in FIGS. 6 and 7).

Figure 8:
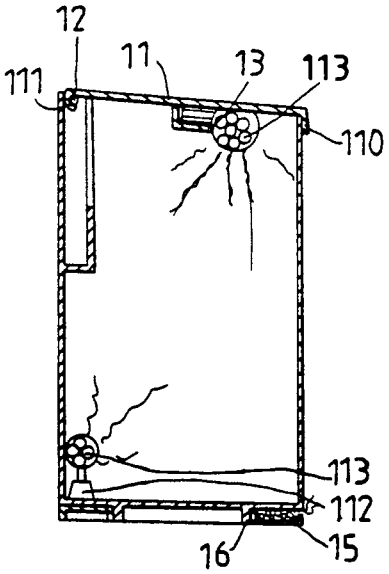
FIG. 8 is a sectional view of the dust bin showing that a camphor box is set in the holder plate on the bottom surface of the cover which is covered on the body at the top, and another camphor box is set in the holder plate at the inside of the body.
Figure 9:
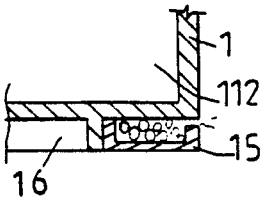
FIG. 9 is a partly sectional view, showing the positioning of the chemical case at the bottom of the body and the gap therebetween.

Referring to FIG. 8, when the cover 1 covers on the body 1 at the top, the camphor balls in the camphor box 113 which is set in the holder plate 13 on the bottom surface of the cover 11 as well as the camphor balls in the camphor box 113 in the holder plate 112 inside the body 1 simultaneously produce a strong, characteristic odor to repel insects. At the same time, the aromatic compounds in the chemical case 15 produce aromatic smell to please one's nostrils. As shown in FIG. 9, the substantially loop-shaped chemical case 15 has a higher top edge around the inner diameter thereof and a relatively lower top edge around the outer diameter thereof. Therefore, when the chemical case 15 is attached to the body 1 at the bottom, a gap is maintained between the bottom surface of the body 1 and the top edge of the chemical case 15 around the outer diameter thereof, through which gap the aromatic smell from the aromatic compounds in the chemical case 15 is diffused. Further, the cheimcal case 15 has a small drain hole 150 at the bottom for drawing off water.

Figure 10:
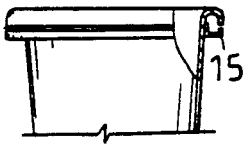
FIG. 10 illustrates an alternate form of the present invention.

Referring to FIG. 10, there is illustrated an alternate form of chemical case 15 according to the present invention which can be conveniently fastened in the hand-hold of any of a variety of dust bins.

As indicated, the present invention is to provide such a structure of dust bin which has means for holding camphor balls or aromatic compounds to repel insects and destroy undesired odors. Further, when the cover is not in use, it can be conveniently received inside the body of the dust bin without causing any pollution problem.

I claim:

1. A dust bin comprised of a container and a cover, said container having an opening at the top through which dust, rubbish, etc. can be put into the holding space defined inside said container, said cover being cover removably covering on said container to close said opening, and characterized in that said container has a flat, hollow chamber vertically disposed inside and separated from said holding space for receiving said cover when said cover is not in use, and two bolts at two opposite locations for mounting said cover through hooked-joint permitting said cover to be releasably rotated on said two bolts from a horizontal position to a vertical position or from a vertical position to a horizontal position.

2. The dust bin of claim 1, wherein said container is covered with a layer of rubber packing on the top edge thereof; said cover has a retaining projection at the front end thereof firmly engaged with said layer of rubber packing when said cover is rotated to a horizontal position covering over said opening.

3. The dust bin of claim 1, wherein said cover has a hooked portion releasably hooked on said two bolts permitting said cover to be rotated on said two bolts.

4. The dust bin of claim 1, wherein a loop-shaped chemical case is attached to said container at the bottom for holding aromatic compounds, said loop-shaped chemical case having a higher top edge around the inner diameter thereof and a lower top edge around the outer diameter thereof so that a gap is maintained between the bottom surface of said container and the top edge of said loop-shaped chemical case for diffusing the aromatic smell which is produced by said aromatic compounds when said loop-shaped chemical case is attached to said container at the bottom.

5. The dust bin of claim 5, wherein said cover has a holder means on the bottom surface thereof at the center for keeping deodorant to repel and destroy undesired odors.

* * * * *